US006123475A

United States Patent [19]

Brings et al.

[11] Patent Number: 6,123,475

[45] Date of Patent: Sep. 26, 2000

[54] METHOD OF CONTROLLING A DOCUMENT-PRINTING ARRANGEMENT AND CORRESPONDING DOCUMENT PRINTING ARRANGEMENT

[75] Inventors: Bernhard Brings; Richard Duesterhus; Bernd Reimer; Pamela Szlezys, all of Paderborn, Germany

[73] Assignee: Siemens Nixdorf Informationssysteme AG, Paderborn, Germany

[21] Appl. No.: 09/331,455

[22] PCT Filed: Dec. 17, 1997

[86] PCT No.: PCT/DE97/02934

§ 371 Date: Jun. 21, 1999

§ 102(e) Date: Jun. 21, 1999

[87] PCT Pub. No.: WO98/28138

PCT Pub. Date: Jul. 2, 1998

[30] Foreign Application Priority Data

| | | | |
|---|---|---|---|
| Dec. 20, 1996 | [DE] | Germany | 196 53 487 |
| Feb. 5, 1997 | [DE] | Germany | 197 04 321 |

[51] Int. Cl.[7] ..... B41J 11/26

[52] U.S. Cl. ..... 400/611; 400/613; 400/614; 400/621; 400/582

[58] Field of Search ..... 400/611, 612, 400/613, 614, 621, 568, 582, 584

[56] References Cited

U.S. PATENT DOCUMENTS

| | | | |
|---|---|---|---|
| 4,594,597 | 6/1986 | Liu et al. | 346/764 |
| 4,891,655 | 1/1990 | Watanabe | 346/151 |
| 5,141,346 | 8/1992 | Nakagawa | 400/605 |
| 5,172,989 | 12/1992 | Imaseki et al. | 400/120 |
| 5,297,783 | 3/1994 | Howard et al. | 270/52.5 |
| 5,351,071 | 9/1994 | Matsuda et al. | 400/614 X |
| 5,529,413 | 6/1996 | Kamikubota et al. | 400/582 |
| 5,549,400 | 8/1996 | Tang et al. | 400/236 |
| 5,588,763 | 12/1996 | Nubson et al. | 400/700 |

FOREIGN PATENT DOCUMENTS

| | | |
|---|---|---|
| 0 409 073 A1 | 1/1991 | European Pat. Off. . |
| 40 14 124 A1 | 11/1991 | Germany . |
| WO 94/21465 | 9/1994 | WIPO . |
| WO 94/22117 | 9/1994 | WIPO . |

*Primary Examiner*—John S. Hilten
*Assistant Examiner*—Minh H. Chau
*Attorney, Agent, or Firm*—Hill & Simpson

[57] ABSTRACT

A document-printing arrangement (8) having one or more paper paths (10, 110), via which one or different continuous paper webs (20, 120) can be fed to a printing station (14) equipped with a thermoprinting strip (32) and a backing roll (34). In order to compensate for transport speed tolerances, a paper bulge (66) is built up upstream of the printing station (14).

8 Claims, 2 Drawing Sheets

METHOD OF CONTROLLING A DOCUMENT-PRINTING ARRANGEMENT AND CORRESPONDING DOCUMENT PRINTING ARRANGEMENT

BACKGROUND OF THE INVENTION

1. Field of the Invention

The present invention relates to a method of controlling a document-printing arrangement and a document-printing arrangement which can be controlled by this method and has a paper transport device for a continuous paper web, in whose paper path there are arranged a pair of drive rollers driven by a motor and a print head which cooperates with a print backing means.

2. Description of the Related Art

International patent application WO 94/21465 A1 has disclosed a document-printing arrangement in which a recording medium—a continuous paper web or else a single sheet—is transported on a paper path by a transport device arranged upstream of a printing station. The transport device is formed by a pair of transport rollers driven by an electric motor. Arranged downstream of the printing station in the paper path is a cutting device for cutting a document off the continuous paper web. Arranged in the paper path between the printing station and the cutting device is a sensor which is suitable for determining the position of the leading edge of the paper web.

A similar document-printing arrangement is also described in the international patent application WO 94/22117 A1. In this application a recording medium—which may be a continuous paper web or else a single sheet—is transported by two transport devices which are arranged one behind the other in the paper transport direction and are driven at the same time. One of the transport devices, formed by a pair of transport rollers, is arranged upstream of a printing station. Although in theory both transport devices have the same transport speed, these may be slightly different because of unavoidable mechanical tolerances. If the pair of transport rollers arranged upstream of the printing station transports more slowly than the other transport device, this manifests itself in a distorted printed image. In the event of stiffness of the recording media, too and thus in the case of an otherwise advantageous stepping motor as the transport roller drive, stepping losses may occur, so that a controlled paper advance is no longer possible.

A further problem may arise if the delivery directions of the two transport devices differ from one another because of circumferential tolerances over the length of the transport rolls. This leads to the continuous paper web running crookedly, which results, at least, in a distorted printed image.

In the document-printing arrangement disclosed by the published international patent application WO 94/21465, the recording medium, in addition to being transported by the abovementioned paper transport device, is also transported by a second transport device, which is arranged downstream of the printing station in the paper transport direction and is driven at the same time as the first paper transport device. The above-mentioned problems therefore also occur for the document-printing arrangement disclosed here.

SUMMARY OF THE INVENTION

An object of the invention is therefore to provide a method of controlling a document-printing arrangement of the type cited and to propose an arrangement which can be controlled by the abovementioned method in such a way that tensile loadings acting on the recording medium are kept away from the printing station.

The objects of the invention are achieved by a method and apparatus, wherein the method of controlling a document-printing arrangement having a paper transport device, in whose paper path there are arranged a pair of drive rollers driven by an electric motor, and a printing station, provides a thermoprinting strip which cooperates with a backing roll driven by an electric motor, where, in order to pull a continuous paper web into the document-printing arrangement, the thermoprinting strip is moved into a position lifted off the backing roll, the leading edge of the continuous paper web is moved into engagement with the pair of drive rollers, a first stepping motor, driving the pair of drive rollers, has applied to it first forward stepping pulses which act in the direction in which the continuous paper web is pulled in, when the leading edge of the continuous paper web is detected by a sensor, the thermoprinting strip is moved into its position close to the backing roll, the first stepping motor has applied to it a predefined number of further first forward stepping pulses while the backing roll is stationary, so that a paper bulge can build up upstream of the printing station, and in order to transport the continuous paper web further, the pair of drive rollers and the backing roll are driven at the same time and in the same direction. The apparatus according to the invention provides a document-printing arrangement having a paper transport device for a continuous paper web, in whose paper path there are arranged a pair of drive rollers driven by a first stepping motor and a print head which cooperates with a print backing means, the print head being designed as a thermoprinting strip and the print backing means being designed as a backing roll which can be driven by a second stepping motor, in that the thermoprinting strip can be displaced, by an electromagnetically operated actuating drive, between a position close to the backing roll and a position lifted off the latter, and in that there is a control device for acting on the first stepping motor and the second stepping motor and the actuating drive.

The present invention is based on the consideration that in printers and copiers, in particular in thermal printers, tensile stresses in the recording medium which have an effect on the printing station can be dissipated if the thermoprinting strip used in such a printer can be displaced, with the aid of an electromechanically operated actuating drive, between a position close to the print backing—here a backing roll—and a position lifted off the latter. In the following text, mention will be made only of continuous paper webs as the recording medium, since the above described problems mainly manifest themselves in the case of these web, because of their great length. The recording medium is then only still held at one point, namely by the pair of drive rollers. Tensile stresses which have built up in the continuous paper web during its transport through the printing station can be equalized.

In order to pull a continuous paper web in, the document-printing arrangement is controlled as follows, according to the invention: before a new continuous paper web is loaded, or during a change between different continuous paper webs, the thermoprinting strip is moved into its position lifted off the backing roll, and then the leading edge of the continuous paper web is moved into engagement with the pair of drive rollers. At this point, at the latest, the first stepping motor, which drive the pair of drive rollers, has applied to it first forward stepping pulses which act in the direction in which the continuous paper web is pulled in, as a result of which the continuous paper web is transported into the printing station. When the leading edge of the continuous paper web is detected by a sensor, that is preferably designed as a light barrier, the thermoprinting strip is moved into its position close to the backing roll, and the first stepping motor has applied to it a predefined number of further first forward stepping pulses. Because the continuous paper web is now held between the thermoprinting strip and the stationary backing roll, and the pair of drive rollers displaces the web in the direction of the printing station, a paper bulge may be built up upstream of the printing station. Its magnitude is determined by the number of further first forward stepping pulses, and is selected such that the paper bulge is not completely dissipated, even given the greatest possible tolerances of the transport roller circumferences and backing roll circumferences and of a maximum document length to be printed.

In order to minimize the above-mentioned crooked running of the continuous paper web, it is proposed, in a development of the invention, after one or even a number of documents have been cut off the continuous paper web, to displace the thermoprinting strip, at least for a predefined time interval, into its position lifted off the backing roll.

In order to realign the continuous paper web with the printing station, the thermoprinting strip is displaced, after a document has been cut off, into its position lifted off the backing roll, and the first stepping motor has applied to it first reverse stepping pulses, which act in the reverse transport direction of the continuous paper web. When the leading edge of the continuous paper web is detected by the light barrier, the thermoprinting strip is moved into its position close to the backing roll, and the first stepping motor, as described above, has applied to it a predefined number of first forward stepping pulses acting in the direction in which the continuous paper web is pulled in.

In order to transport the continuous paper web further, the pair of drive rollers and the backing roll are driven at the same time, preferably by the first and the second stepping motor having applied to them mutually synchronized forward or reverse stepping pulses. As a result, the paper bulge is retained both during the reverse transport of the continuous paper web to a first printing position that is close to the leading edge of the continuous paper web, and during its forward transport during a printing operation.

The thermoprinting strip of a preferred embodiment can be displaced by a sixth stepping motor, which is mounted so as to displace a rotable eccentric element acting on the thermoprinting strip. For its part, the latter acts on the thermoprinting strip and pivots it between its position close to the backing roll and its position lifted off the latter. The respective position of the thermoprinting strip can easily be determined, without additional sensors, from the number and direction of the stepping pulses driving the sixth stepping motor.

In a development of the invention, the paper transport device comprises at least two paper paths, leading into the printing station, each one being for one continuous paper web. The paper paths are essentially of identical construction, and each is assigned a pair of drive rollers which can be driven by a separate stepping motor. This makes it possible to print different forms, such as check forms, account statements or transfer preprints, each of which is preprinted on a continuous paper web.

The control of the document-printing arrangement expanded in this way is carried out as described above for a single paper path; the stepping motor of the pair of drive rollers assigned to a continuous paper web is driven only when loading this continuous paper web and for the purpose of realigning the latter after a cutting-off operation. In order to change over between different continuous paper webs, the web located in the printing station is transported back to such an extent that it is just still held by the associated pair of drive rollers. The leading edge of the continuous paper web which is subsequently to be printed is either moved into engagement with the associated pair of drive rollers, as described above, or is already engaged with the latter. The continuous paper web can be transported into the printing station as soon as the preceding web has been transported out of the latter. The stepping pulses of the individual stepping motors can easily be counted by the control device and their number can be stored, so that the position of the leading edges of the individual continuous paper webs is known at any time. As a result of this and the fact that the pairs of drive rollers can only be driven alternately, at least in the direction in which the respective continuous paper web is pulled in, collisions between the continuous paper webs can be reliably avoided.

BRIEF DESCRIPTION OF THE DRAWINGS

In the following text, the invention will be described using an exemplary embodiment illustrated in the drawing, in which.

DETAILED DESCRIPTION OF THE PREFERRED EMBODIMENTS

Figure 1:
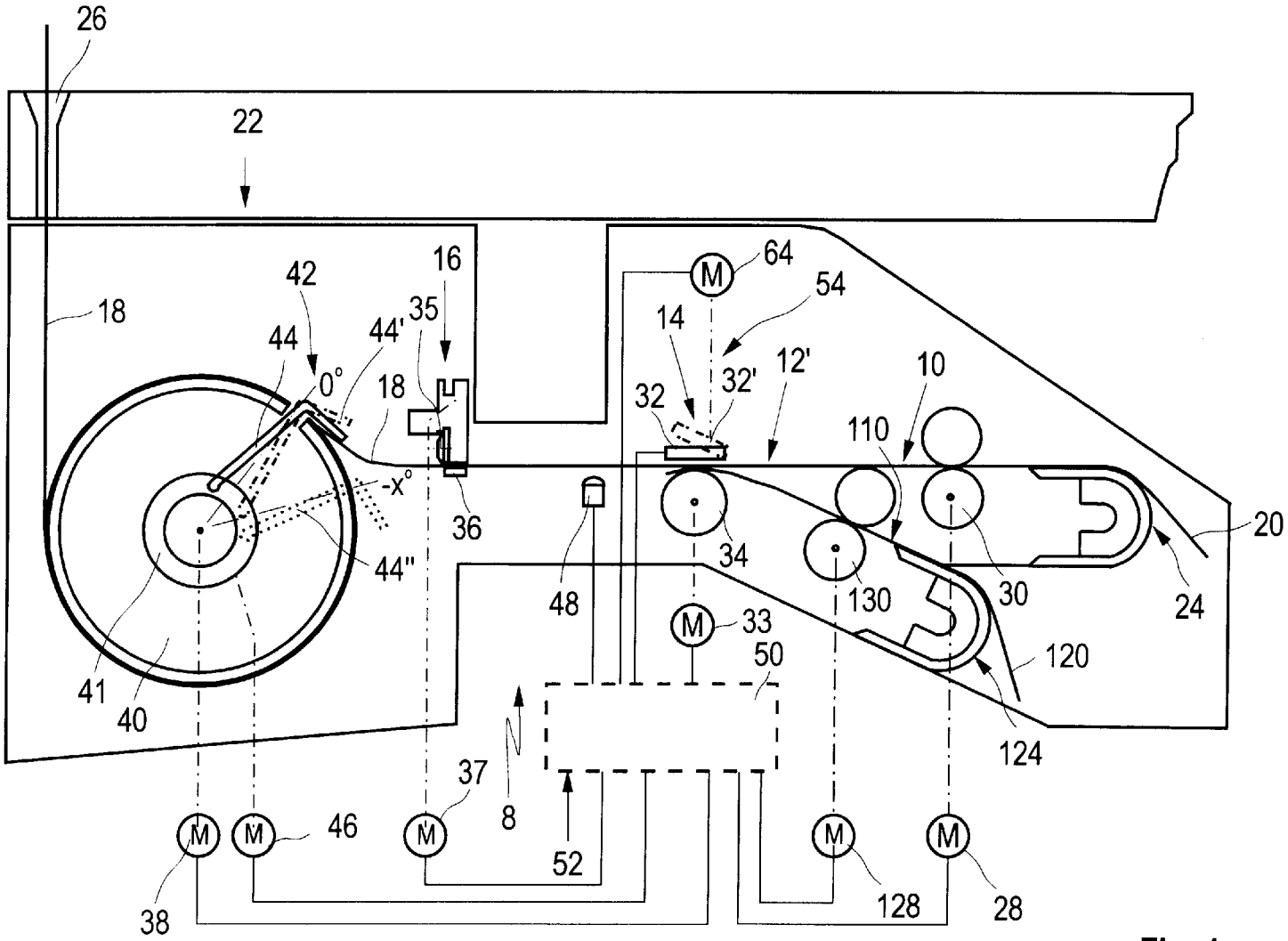
FIG. 1 shows a schematic sectional illustration of a document-printing arrangement.

A document-printing arrangement 8 illustrated schematically in FIG. 1 contains a paper transport device 12' comprising two paper paths 10, 110, which is followed by a printing station 14, a cutting device 16 for separating individual documents 18 from two different continuous paper webs 20, 120, and a document collecting station 22 for separated documents 18. The continuous paper web 20, 120 may in each case be rolled up on a reel or Z-folded. They may be blank or provided with pre-printed forms, which are only filled out in the printing station 14.

The paper paths 10, 110 extend from their respective entrance region 24, 124 for the input of one of the continuous paper webs 20, 120, as far as the printing station 14, and from there lead jointly to an output slot 26 for the output of fully printed documents 18. The entrance region 24 is followed by a pair of drive rollers 30 driven by a first stepping motor 28, and the entrance region 124 is followed by a pair of drive rollers 130 driven by a further first stepping motor 128. The printing station 14 comprises a thermoprinting strip 32 arranged above the paper path 10/110, already running together in this region, and a backing roll 34, which is arranged opposite the thermoprinting strip 32 and underneath the paper path 10/110 and is driven by a second stepping motor 33. The thermoprinting strip 32 can be displaced, with the aid of an actuating drive 54, between a position close to the backing roll 34 and a position 32' lifted off the latter. Inserted into the paper path 10/110 downstream of the printing station 14 is a light barrier 48, which responds to the leading edge of the continuous paper webs 20 and 120.

In the paper path 10/110, arranged downstream of the light barrier 48, there is the cutting device 16, having a blade which is designed as a cutting roller 35 and cooperates with a cutting rail 36. The cutting roller 35 can be displaced at right angles to the transport direction of the continuous paper webs 20, 120, over their entire width, by a third stepping motor 37. The cutting device 16 is used to cut the documents 18 off the continuous paper webs 20, 120 and thus to separate them.

The cutting device 16 is followed by the document collecting station 22, whose basic construction and function are described in German Patent Document DE 42 25 418 A1 and are therefore explained here only to the extent which is necessary for the understanding of the present invention. The document collecting station 22 contains a drum 40, which can be driven in both directions of rotation by a fourth stepping motor 38 and which transports the individual documents 18 into a gripper 42. The latter is designed as clamping elements 44, which are arranged on the outside of the drum 40 and can be displaced between a clamping position in contact with the circumferential surface of said drum (illustrated with continuous lines) and a raised release position (illustrated dash-dotted) irrespective of the rotary drive of the drum 40. However, while in the arrangement according to the German Patent Document DE 42 25 418 A1 the displacement of the clamping elements and the drive to the drum are performed by a single drive, to which these elements can selectively be coupled, the clamping elements 44 here are actuated by a separate drive, a fifth stepping motor 46. The latter is able to rotate an actuating ring 41, which pivots the clamping elements and is arranged concentrically with respective to the drum 40, in both directions of rotation in relation to the drum 40. The gripper 42 is opened when the actuating ring 41 is rotated in the clockwise direction and closed when said ring is rotated in the counterclockwise direction. This makes it possible to displace the clamping elements 44 during the rotation of the drum 40.

Figure 2:
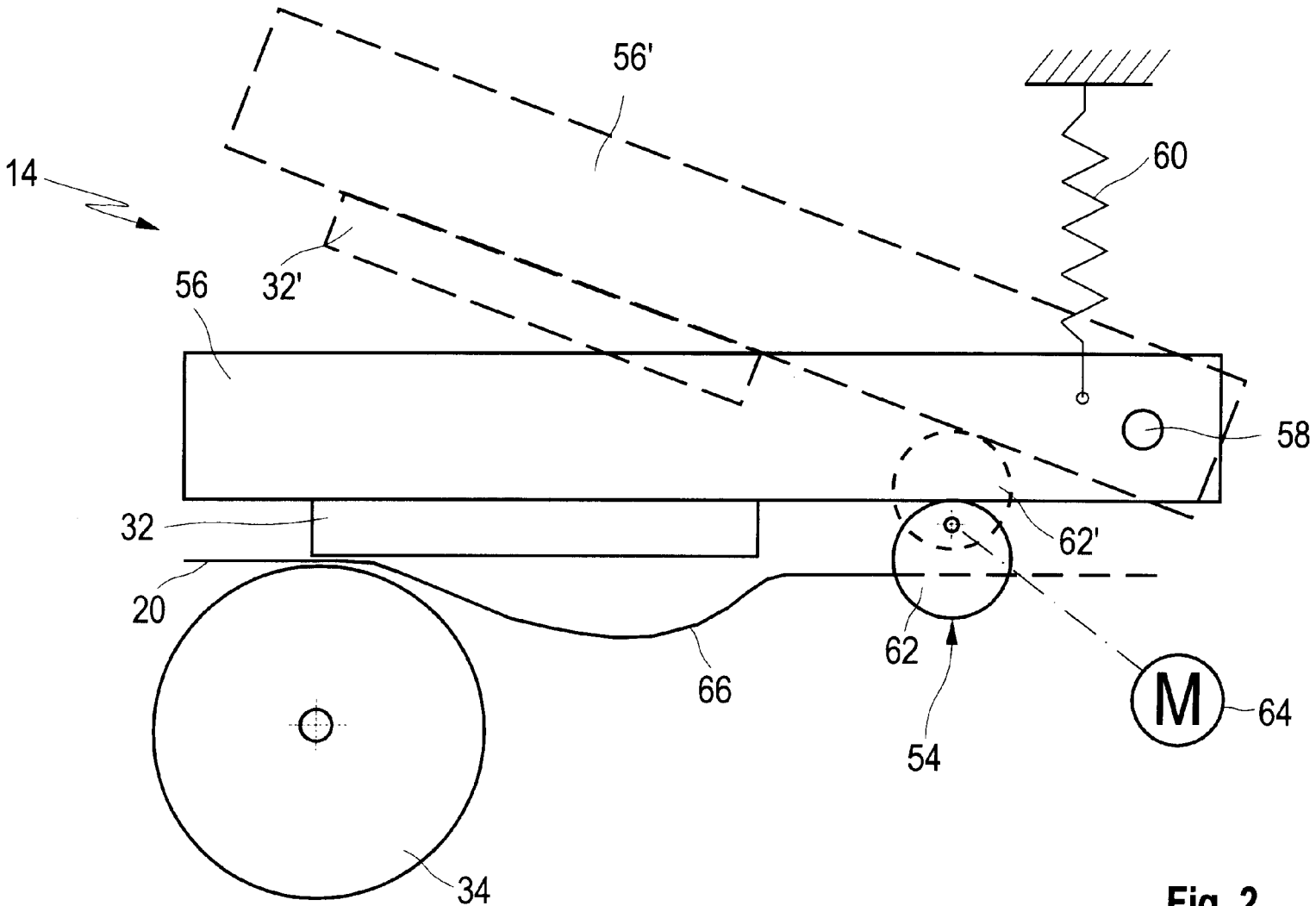
FIG. 2 shows a schematic illustration of the printing station in FIG. 1.

FIG. 2 shows the actuating drive 54 in detail. The thermoprinting strip 32 is fitted to a printing-strip holder 56, which can pivot about a pivot axis 58. The printing-strip holder 56 is loaded in the direction of the backing roll 34 with the force of a compression spring 60. In the position in which the thermoprinting strip 32 is lifted off the backing roll 34, the printing-strip holder 56 is supported on an eccentric shaft 62, which is connected to a sixth stepping motor 64 so as to rotate with it. In FIG. 2, the thermoprinting strip 32, printing-strip holder 56 and eccentric shaft 62 are illustrated with continuous lines in the position in which the thermoprinting strip 32 is close to the backing roll 34. In the position in which the thermoprinting strip is lifted off the backing roll 34, the abovementioned constructional elements are illustrated with dashed lines and are designated by 32', 56' and 62', respectively.

The seven stepping motors 28, 33, 37, 38, 46, 64 and 128, the thermoprinting strip 32 and the light barrier 48 are connected to a control device 50, which is fed with print jobs from outside the document-printing arrangement 8 via a data line 52. The control device 50 controls the document-printing arrangement 8 in the manner described below for a document-processing operation.

In order to pull a continuous paper web 20 or 120 into the document-printing arrangement 8, the latter is controlled as follows: before a new continuous paper web 20, 120 is loaded, the thermoprinting strip 32 is moved into its position 32' lifted off the backing roll 34. For this purpose, the eccentric shaft 62 is rotated into its position 62' with the aid of the sixth stepping motor 64. At the same time, it pivots the printing-strip holder 56, together with the thermoprinting strip 32, into its position 56', counter to the force of the compression spring 60. The leading edge of the continuous paper web 20 or 120 is then moved by hand into engagement with one of the pairs of drive rollers 30, 130. At this point, at the latest, the first stepping motor 28, driving the first pair of drive rollers 30, or the further first stepping motor 128, driving the second pair of drive rollers 130, has applied to it first forward stepping pulses which act in the direction in which the continuous paper web 20 or 120 is pulled in, as a result of which the corresponding continuous paper web 20 or 120 is transported into the printing station 14. When the leading edge of the continuous paper web 20 or 120 is detected by the light barrier 48, the printing-strip holder 56 and hence the thermoprinting strip 32 is moved into its position close to the backing roll 34, this taking place with the aid of the restoring force stored in the compression spring 60. This force is released by rotating the eccentric shaft back into its position 62. The first stepping motor 28 or the further first stepping motor 128 has applied to it a predefined number of further first forward stepping pulses. Because the continuous paper web 20 or 120 is now held between the thermoprinting strip 32 and the stationary backing roll 34, and the pair of drive rollers 30 or 130 displaces the continuous paper web 20 or 120 in the direction of the printing station 14, a paper bulge 66 can build up upstream of the printing station 14.

In order to realign the continuous paper web 20 or 120 with the printing station 14, the thermoprinting strip 32 is displaced, after a document 18 has been cut off, into its position 32' lifted off the backing roll 34, and the first stepping motor 28 or the further first stepping motor 128 has applied to it first reverse stepping pulses which act in the reverse transport direction of the continuous paper web 20 or 120. When the leading edge of the continuous paper web 20 or 120 is detected by the light barrier 48, the thermoprinting strip 32 is moved into its position close to the backing roll, and the first stepping motor 28 or the further first stepping motor 128 has applied to it, as described above, a predefined number of first forward stepping pulses which act in the direction in which the continuous paper web is pulled in.

The document-printing operation begins with the continuous paper web 20 or 120 being transported along its paper path 10 or 110 until the light barrier 48 detects the leading edge of the continuous paper web. The thermoprinting strip 32 is then at a defined distance from the leading edge of said continuous paper web. The stepping pulses of the second stepping motor 33 are counted from there on, so that the printing of a document on the correct lines can take place. Since the printing operation using the thermoprinting strip is accompanied by a continuous paper advance, the time which elapses until the leading edge of the continuous paper web 20 or 120 strikes the drum 40 is known, and therefore so is the number of stepping pulses which still have to be fed to the second stepping motor 33.

When a step which is predefined by the geometry of the document-printing arrangement 8 and the circumferential speed of the backing roller 34 is reached, the fourth stepping motor 38 has applied to it a stepping pulse train which corresponds to a defined acceleration ramp of the drum 40 up to a circumferential speed which corresponds to the advance speed of the continuous paper web 20. It is assumed here that the drum 40 is at a rotational angle position $-x°$. In this position, the clamping elements lifted off the circumferential surface of the drum 40 are located in a position 44" (illustrated dotted) underneath the line of contact between the continuous paper web 20 and the drum 40. The stepping pulse train is selected such that the drum 40 has just reached its rotational angle position 0° at the point at which the leading edge of the continuous paper web 20 meets said drum, and is rotating at a circumferential speed which corresponds to the advance speed of the continuous paper web 20. In this position, the clamping elements are lifted off the circumferential surface of the drum and are located in the position 44' illustrated dash-dotted. As soon as the drum 40 has traveled past the rotational angle position 0°, the fifth stepping motor 46 is energized in such a way that the actuating ring 41 is rotated in the counterclockwise direction in relation to the drum 40, as a result of which the gripper 42 closes during the rotation of the drum.

The pair of drive rollers 30 or 130, the backing roll 34 and the drum 40 continue to be operated in the forward transport direction of the continuous paper web 20 or 120 until the desired length of the document 18 has been reached. The first or the further first, the second and the fourth stepping motors 28 or 128, 33, 38 then have applied to them stepping pulses of a defined braking ramp, which is such that the continuous paper web 20 or 120 is always tautly tensioned between the backing roll 34 and the drum 40. When the stepping motors 28 or 128, 33, 38 are at a standstill, the lower edge of the document 18 is located on the cutting line of the cutting device 16, which is now operated by supplying the third stepping motor 37 with an appropriate stepping pulse train. The first stepping motor 28 or the further first stepping motor 128 and the second stepping motor 33 are then operated in the direction opposite to the pulling-in direction of the paper transport device 12, as a result of which the continuous paper web 20 or 120 is conveyed backward until its leading edge exposes the light barrier 48 again. The fourth stepping motor 38 rotates the drum 40 in the counterclockwise direction until the rotational angle position −x° is reached again.

For each document 18 to be picked up, the drum 40 completes one revolution in the counterclockwise direction. Once a number of documents 18 determined by a current print job has been deposited in the gripper 42, the direction of rotation of the drum 40 is reversed, and the bundle of documents is provided in the output slot 26 for removal. For this purpose, the gripper 42 is opened.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method of controlling a document-printing arrangement having a paper transport device, in whose paper path there are arranged a pair of drive rollers driven by an electric motor, and a printing station which includes a thermoprinting strip which cooperates with a backing roll driven by an electric motor, where, in order to pull a continuous paper web into the document-printing arrangement, the method comprising the steps of:

moving the thermoprinting strip into a position lifted off the backing roll, moving the leading edge of the continuous paper web into engagement with the pair of drive rollers, applying first forward stepping pulses to a first stepping motor for driving the pair of drive rollers which act in the direction in which the continuous paper web is pulled in, when the leading edge of the continuous paper web is detected by a sensor, moving the thermoprinting strip into its position close to the backing roll, applying a predefined number of further first forward stepping pulses to the first stepping motor while the backing roll is stationary, so that a paper bulge is formed upstream of the printing station, and in order to transport the continuous paper web further, driving the pair of drive rollers and the backing roll at the same time and in the same direction.

2. The method of controlling a document-printing arrangement as claimed in claim 1, further comprising the steps of:

cutting one or more documents off the continuous paper web by a cutting device arranged in the paper path downstream of the printing station, and displacing the thermoprinting strip, at least for a predefined time interval, into its position lifted off the backing roll.

3. The method of controlling a document-printing arrangement as claimed in claim 1, further comprising the steps of:

cutting a document off the continuous paper web by a cutting device arranged in the paper path downstream of the printing station, displacing the thermoprinting strip into its position lifted off the backing roll, applying first reverse stepping pulses to the first stepping motor which act in the reverse transport direction of the continuous paper web, when the leading edge of the continuous paper web is detected by the light barrier, moving the thermoprinting strip into its position close to the backing roll, applying the predefined number of first forward stepping pulses to the first stepping motor, which act in the direction in which the continuous paper web is pulled in, while the backing roll is at a standstill, so that a paper bulge is formed upstream of the printing station, and wherein to transport the continuous paper web further, driving the pair of drive rollers and the backing roll at the same time and in the same direction.

4. The method of controlling a document-printing arrangement as claimed in claim 1, wherein in order to transport the continuous paper web further, the first stepping motor and a second stepping motor, which drives the backing roll, have applied to them mutually synchronous forward or reverse stepping pulses.

5. A document-printing arrangement, comprising:

a paper transport device for a continuous paper web and having a paper path;

a pair of drive rollers in said paper path;

a first stepping motor connected to drive said pair of drive rollers;

a print head in said paper path;

a print backing element positioned in said paper path to cooperate with said print head, wherein the print head includes a thermoprinting strip; the print backing element being a backing roll;

a second stepping motor connected to drive said backing roll;

an electromagnetically operated actuating drive connected to displace the thermoprinting strip between a position close to the backing roll and a position lifted off the backing roll; and a control device for acting on the first stepping motor and the second stepping motor and the actuating drive, said control device feeding the paper web to create a bulge and holding the backing roll stationary.

6. The document-printing arrangement as claimed in claim 5, wherein the actuating drive includes an eccentric which is rotatable by a sixth stepping motor and which in turn acts on the thermoprinting strip.

7. The document-printing arrangement as claimed in claim 5, further comprising:

at least one further paper path leading through the printing station for a further continuous paper web;

a further pair of drive rollers in said at least one further paper path; and a further first stepping motor connected to drive said further pair of drive rollers.

8. The document-printing arrangement as claimed in claim 7, wherein the pair of drive rollers and the further pair of drive rollers is pulled in.

* * * * *